US005684461A

United States Patent [19]

Jones

[11] Patent Number: 5,684,461

[45] Date of Patent: Nov. 4, 1997

[54] SLEEP PREVENTION DEVICE FOR A DRIVER OF A VEHICLE

[76] Inventor: Richard Sidney Jones, 8 Stone Pine, Irvine, Calif. 92714

[21] Appl. No.: 733,731

[22] Filed: Oct. 18, 1996

[51] Int. Cl.[6] ..... G08B 23/00

[52] U.S. Cl. ..... 340/575; 340/439

[58] Field of Search ..... 340/575, 576, 340/439

[56] References Cited

U.S. PATENT DOCUMENTS

| | | | |
|---|---|---|---|
| 3,953,831 | 4/1976 | Estrada | 340/575 |
| 3,999,177 | 12/1976 | Greene | 340/576 |
| 4,177,460 | 12/1979 | Hoinski et al. | 340/576 |

*Primary Examiner*—Thomas Mullen
*Assistant Examiner*—Daniel J. Wu

[57] ABSTRACT

A sleep prevention device for a driver of a vehicle including a head set with a U-shaped configuration. Also included is a mercury switch assembly with at least one mercury switch. Mercury resides within each mercury switch and closes contacts located therein upon a head of the driver tilting forward or rearwardly. Upon the closing of such and closes activation signal may be transmitted. Further provided is an alarm unit including an alarm for indicating to the driver the receipt of the activation signal. The alarm unit is connected to contacts of the mercury switches, the alarm, and a power source and further adapted to transmit an alarm signal to the alarm upon the transmission of the activation signal.

1 Claim, 3 Drawing Sheets

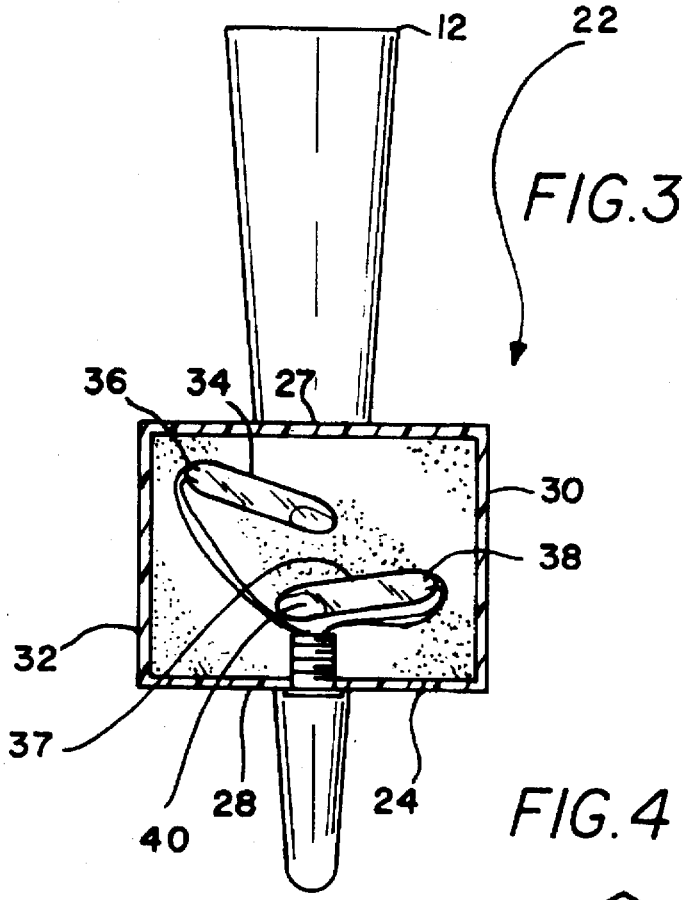
FIG.3
FIG.4
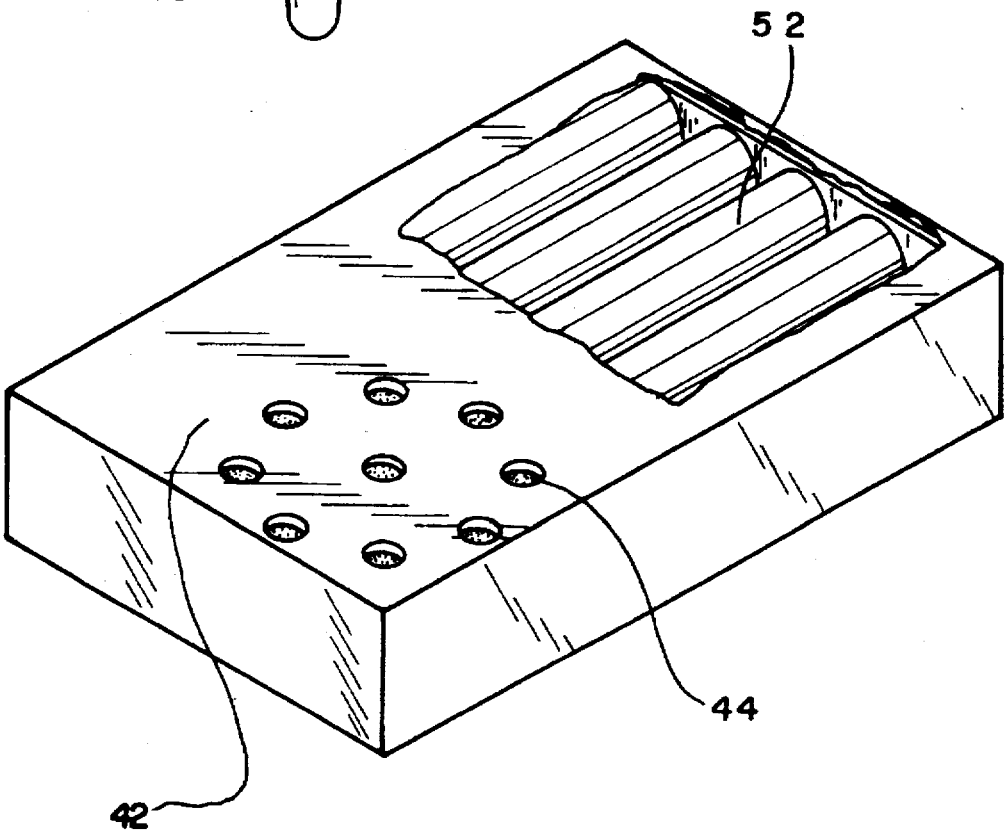

SLEEP PREVENTION DEVICE FOR A DRIVER OF A VEHICLE

BACKGROUND OF THE INVENTION

1. Field of the Invention

The present invention relates to a sleep prevention device for a driver of a vehicle and more particularly pertains to preventing a driver from falling asleep by providing an alarm upon a user's head tilting rearward past a predetermined amount or slightly forward.

2. Description of the Prior Art

The use of sleep prevention devices is known in the prior art. More specifically, sleep prevention devices heretofore devised and utilized for the purpose of preventing a driver from sleeping are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,354,179 to Fourcade; U.S. Pat. No. 3,953,831 to Estrada; U.S. Pat. No. 4,555,697 to Thackrey; U.S. Pat. No. 5,402,109 to Mannik; U.S. Pat. No. 5,353,013 to Estrada; and U.S. Pat. No. Des. 354,958 to Grasso et al.

In this respect, the sleep prevention device for a driver of a vehicle according to the present invention substantially departs from the conventional concepts and designs of the prior art, and in so doing provides an apparatus primarily developed for the purpose of preventing a driver from falling asleep by providing an alarm upon a user's head tilting rearward past a predetermined amount or slightly forward.

Therefore, it can be appreciated that there exists a continuing need for a new and improved sleep prevention device for a driver of a vehicle which can be used for preventing a driver from falling asleep by providing an alarm upon a user's head tilting rearward past a predetermined amount or slightly forward. In this regard, the present invention substantially fulfills this need.

SUMMARY OF THE INVENTION

In view of the foregoing disadvantages inherent in the known types of sleep prevention devices now present in the prior art, the present invention provides an improved sleep prevention device for a driver of a vehicle. As such, the general purpose of the present invention, which will be described subsequently in greater detail, is to provide a new and improved sleep prevention device for a driver of a vehicle which has all the advantages of the prior art and none of the disadvantages.

To attain this, the present invention essentially comprises a head set with a U-shaped configuration having a top arcuate portion, a pair of arms depending therefrom, and a pad lining an inner surface thereof, wherein the head set may be positioned on a head of a vehicle driver with the arms and top portion substantially residing in a vertical plane perpendicularly situated with respect to a direction in which the driver is facing; a mercury switch assembly including a housing fixedly attached to one of the arms of the head set via a plurality of rivets, the housing having a top face facing upwardly with respect to the driver, a bottom face facing downwardly with respect to the driver, a front face facing forwardly with respect to the driver, and a rear face facing rearwardly with respect to the driver, the mercury switch assembly also including a first hollow linear cylindrical mercury switch positioned within the housing and having a pair of contacts situated therein adjacent a first end thereof wherein an axis about which the first mercury is situated forms a 10 degree angle with a horizontal and the first end thereof resides above a second opposite end thereof adjacent the top face and rear face of the housing, the mercury switch assembly including a second mercury switch positioned within the housing and having a pair of contacts situated therein adjacent a first end thereof wherein an axis about which the second mercury switch is situated coincides with the horizontal and the first end thereof is positioned forwardly with respect to the second end adjacent the front wall and the bottom wall, wherein mercury resides within each mercury switch and closes the contacts upon a head of the driver tilting slightly forward or rearwardly a degree greater than 10 degrees thereby allowing the transmission of an activation signal; and an alarm with a rectangular configuration including a housing with a top face, a bottom face, a front face, and a pair of side faces formed therebetween defining an interior space, the alarm unit further including a speaker situated within the interior space for emitting an alarm upon the receipt of the activation signal, whereby the alarm unit is connected to contacts of the mercury switches, the speaker, and a power source and further adapted to transmit an alarm signal to the speaker upon the allowed transmission of the activation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sleep prevention device for a driver of a vehicle which has all the advantages of the prior art sleep prevention devices and none of the disadvantages.

It is another object of the present invention to provide a new and improved sleep prevention device for a driver of a vehicle which may be easily and efficiently manufactured and marketed.

It is a further object of the present invention to provide a new and improved sleep prevention device for a driver of a vehicle which is of a durable and reliable construction.

An even further object of the present invention is to provide a new and improved sleep prevention device for a driver of a vehicle which is susceptible of a low cost of manufacture with regard to both materials and labor, and which accordingly is then susceptible of low prices of sale to the consuming public, thereby making such sleep prevention device for a driver of a vehicle economically available to the buying public.

Still yet another object of the present invention is to provide a new and improved sleep prevention device for a driver of a vehicle which provides in the apparatuses and methods of the prior art some of the advantages thereof, while simultaneously overcoming some of the disadvantages normally associated therewith.

Still another object of the present invention is to prevent a driver from falling asleep by providing an alarm upon a user's head tilting rearward past a predetermined amount or slightly forward.

Another object of the present invention is to provide a device which may also be utilized to prevent a person from falling asleep in bed while smoking.

Lastly, it is an object of the present invention to provide a new and improved sleep prevention device for a driver of a vehicle including a head set with a U-shaped configuration. Also included is a mercury switch assembly with at least one mercury switch. Mercury resides within each mercury switch and closes contacts located therein upon a head of the driver tilting forward or rearwardly. Upon the closing of such contacts, an activation signal may be transmitted. Further provided is an alarm unit including an alarm for indicating to the driver the receipt of the activation signal. The alarm unit is connected to contacts of the mercury switches, the alarm, and a power source and further adapted to transmit an alarm signal to the alarm upon the transmission of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view showing a cross-section of the mercury switch assembly and mercury switches thereof.

FIG. 4 is a perspective view of the alarm unit utilizing batteries for power.

Similar reference characters refer to similar parts throughout the several views of the drawings.

DESCRIPTION OF THE PREFERRED EMBODIMENT

Figure 1:
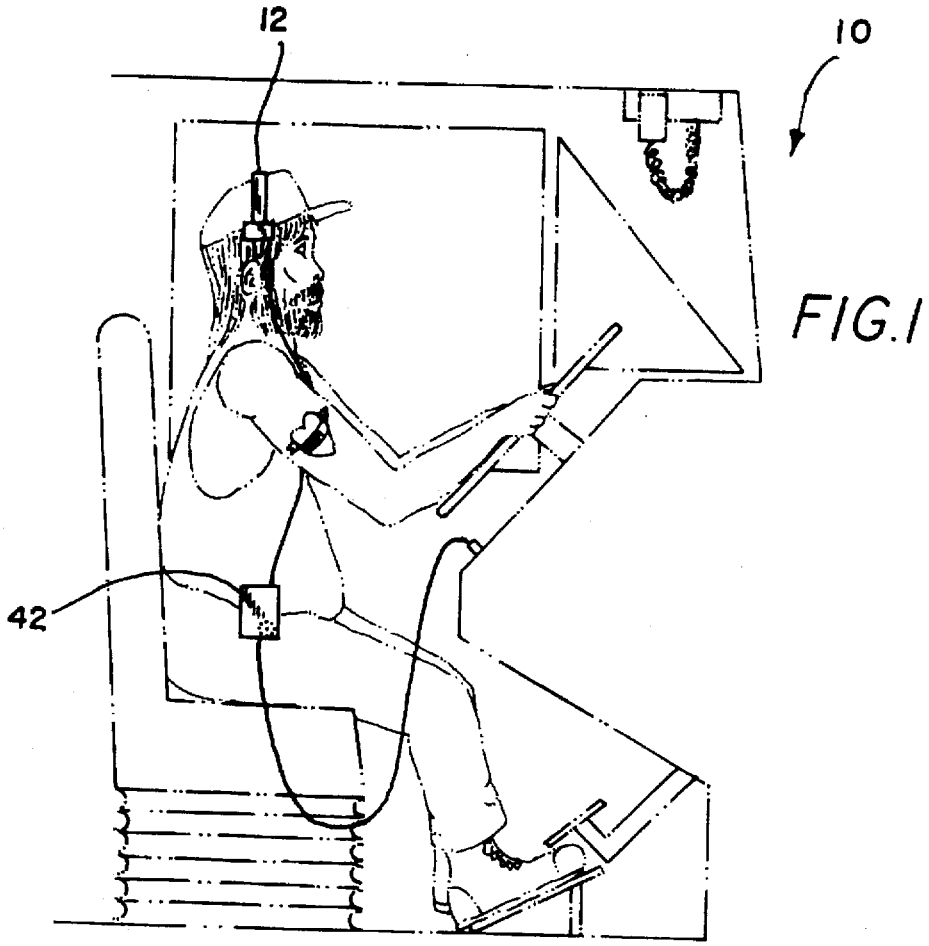
FIG. 1 is a perspective illustration of the preferred embodiment of the sleep prevention device for a driver of a vehicle constructed in accordance with the principles of the present invention.
Figure 2:
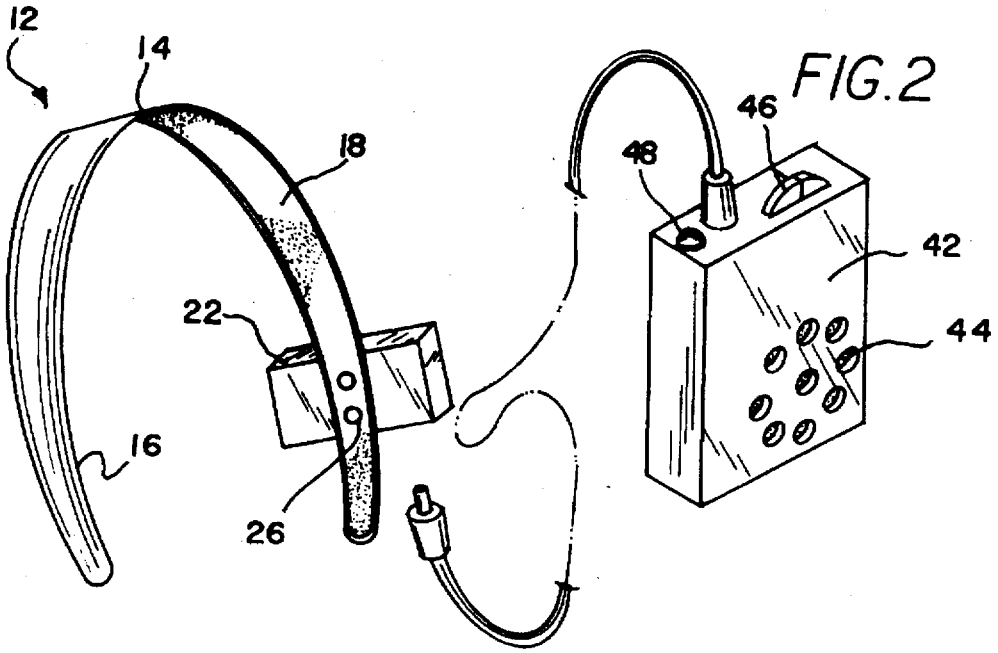
FIG. 2 is a perspective view of the components of the present invention.
Figure 5:
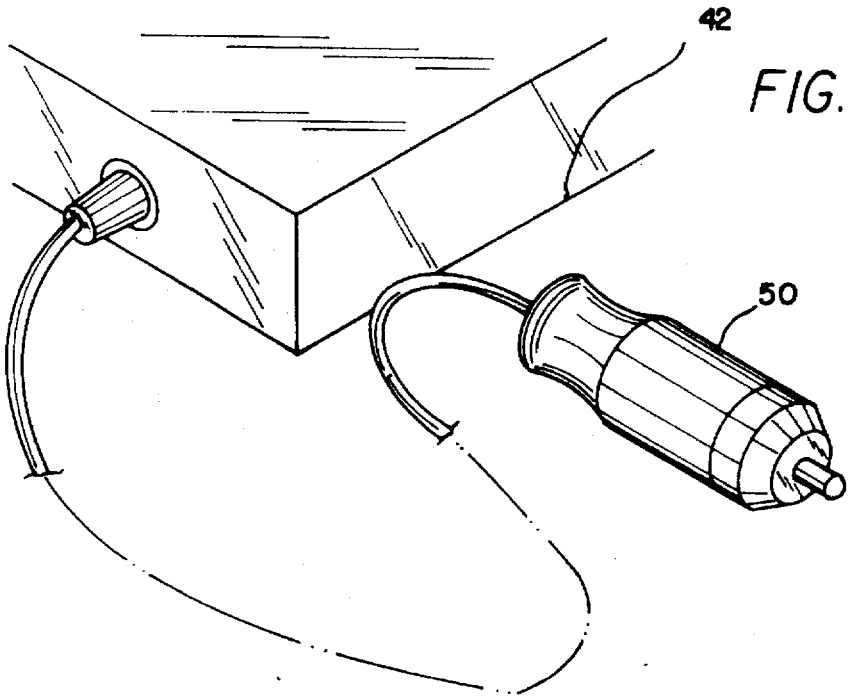
FIG. 5 is a perspective view of the alarm unit utilizing a power adapter for power.

With reference now to the drawings, and in particular to FIG. 1 thereof, a new and improved sleep prevention device for a driver of a vehicle embodying the principles and concepts of the present invention and generally designated by the reference numeral 10 will be described.

The present invention, the new and improved sleep prevention device for a driver of a vehicle, is comprised of a plurality of components. Such components in their broadest context include a headset, a mercury switch assembly, and an alarm unit. Such components are individually configured and correlated with respect to each other so as to attain the desired objective.

More specifically, it will be noted that the system 10 of the present invention includes a head set 12 with a U-shaped configuration having a top arcuate portion 14 and a pair of arms 16 depending therefrom. A pad 18 lines an inner surface of the head set. In use, the head set may be positioned on a head of a vehicle driver with the arms and top portion substantially residing in a vertical plane perpendicularly situated with respect to a direction in which the driver is facing.

For monitoring the orientation of a head of the driver, a mercury switch assembly 22 is included. Such assembly has a housing 24 fixedly attached to one of the arms of the head set via a plurality of rivets 26. As shown in the Figures, the housing has a top face 27 facing upwardly with respect to the driver, a bottom face 28 facing downwardly with respect to the driver, a front face 30 facing forwardly with respect to the driver, and a rear face 32 facing rearwardly with respect to the driver. The mercury switch assembly also includes a first hollow linear cylindrical mercury switch 34 positioned within the housing. The mercury switch has a pair of contacts 36 situated therein adjacent a first end thereof. An axis about which the first mercury is situated forms a 10 degree angle with a horizontal. The first end of the first mercury switch resides above a second opposite end thereof adjacent the top face and rear face of the housing. In addition, the mercury switch assembly includes a second mercury switch positioned within the housing. Similar to the first switch, the second mercury switch 38 has a pair of contacts situated therein adjacent a first end thereof. It should be noted that an axis about which the second mercury switch is situated coincides with the horizontal and further the first end thereof is positioned forwardly with respect to the second end adjacent the front wall and the bottom wall. It is imperative that a plane in which the axes of the mercury switches reside remains perpendicular with respect to the vertical plane of the headset.

Mercury 40 is situated within each mercury switch and, as such, closes the contacts upon a head of the driver tilting slightly forward below the horizontal or rearwardly a degree greater than 10 degrees thereby allowing the transmission of an activation signal. It should be noted that the contacts will also be closed if a head of the driver is tilted left or right as long as the above conditions are met.

As shown in FIG. 4, an alarm 42 with a rectangular configuration is included. The alarm is situated within a housing with a top face, a bottom face, a front face, and a pair of side faces formed therebetween defining an interior space. The alarm unit further includes a speaker 44 situated within the interior space for emitting an alarm upon the receipt of the activation signal. The alarm unit is connected to contacts of the mercury switches, the speaker, and a power source. As such, the alarm unit transmits an alarm signal to the speaker upon the allowed transmission of the activation signal. As an option, a volume control dial 46 may be situated on a top face of the housing for allowing the user to select the volume in which the alarm sounds. It should be noted that such dial may be rotated entirely in one direction for deactivation of the present invention. Also, a light emitting diode 48 is situated on the top face of the alarm unit for indicating whether the present invention is actuated.

Power is ideally provided to the alarm unit via a conventional 12 volt adapter 50 which inserts within a cigarette lighter of a vehicle. Alternatively, batteries 52 may be employed for powering purposes, as shown in FIG. 4.

Figure 6:
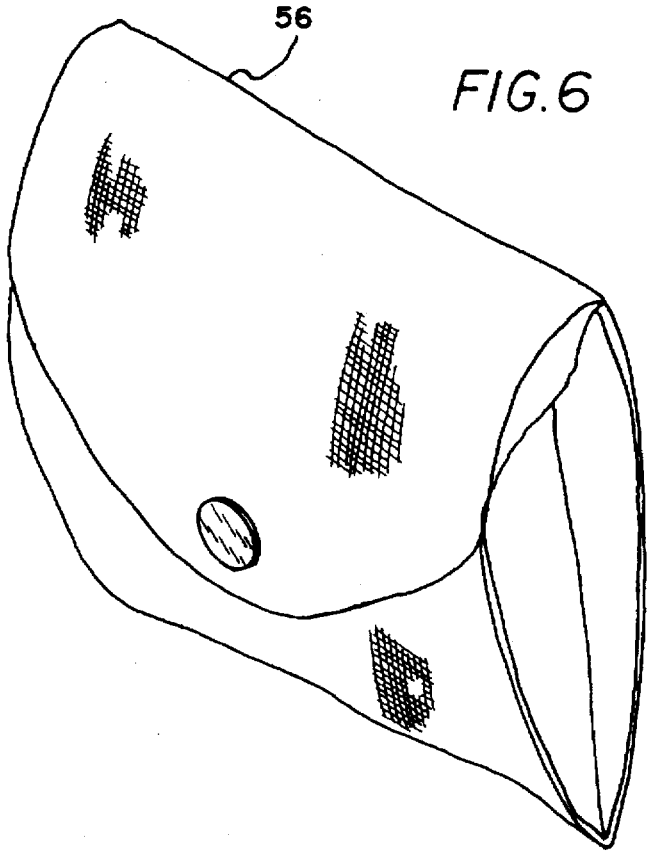
FIG. 6 is a pouch for storage of the present invention.

For allowing a user to conventionally tote the present invention, a pouch 56 is included, as shown in FIG. 6. The pouch is of a flexible type and has a cover for allowing the alarm unit and head set to be stored therein whereat the pouch may be secured shut with a snap button. In the pouch, the alarm unit may be positioned between the arms of the headset for efficiently utilizing the space therein.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A sleep prevention device for a driver of a vehicle comprising, in combination:

a head set with a U-shaped configuration having a top arcuate portion, a pair of arms depending therefrom, and a pad lining an inner surface thereof, wherein the head set may be positioned on a head of a vehicle driver with the arms and top portion substantially residing in a vertical plane perpendicularly situated with respect to a direction in which the driver is facing;

a mercury switch assembly including a housing fixedly attached to one of the arms of the head set via a plurality of rivets, the housing having a top face facing upwardly with respect to the driver, a bottom face facing downwardly with respect to the driver, a front face facing forwardly with respect to the driver, and a rear face facing rearwardly with respect to the driver, the mercury switch assembly also including a first hollow linear cylindrical mercury switch positioned within the housing and having a pair of contacts situated therein adjacent a first end thereof wherein an axis about which the first mercury switch is situated forms a 10 degree angle with a horizontal and the first end thereof resides above a second opposite end thereof adjacent the top face and rear face of the housing, the mercury switch assembly including a second mercury switch positioned within the housing and having a pair of contacts situated therein adjacent a first end thereof wherein an axis about which the second mercury switch is situated coincides with the horizontal and the first end thereof is positioned forwardly with respect to the second end adjacent the front wall and the bottom wall, the axes of the mercury switches defining a plane perpendicular with respect to a vertical plane defined by the headset, wherein mercury resides within each mercury switch and closes the contacts upon a head of the driver tilting slightly forward or rearwardly a degree greater than 10 degrees thereby allowing the transmission of an activation signal;

an alarm including a housing with a rectangular configuration having a top face, a bottom face, a front face, and a pair of side faces formed therebetween defining an interior space, the alarm unit further including a speaker situated within the interior space for emitting an alarm upon the receipt of the activation signal, whereby the alarm unit is connected to contacts of the mercury switches, the speaker, and a power source and further adapted to transmit an alarm signal to the speaker upon the allowed transmission of the activation signal;

a volume control dial situated on the top face of the housing for allowing the user to select the volume in which the alarm sounds, wherein the dial may be rotated entirely in one direction for deactivation of the present invention;

a light emitting diode situated on the top face of the alarm unit for indicating whether the present invention is actuated;

a 12 volt adapter adapted to be inserted within a cigarette lighter of a vehicle for powering purposes; and a flexible pouch for the allowing the alarm and head set to be stored therein whereat the pouch may be secured shut with a snap button, whereby the alarm may be positioned between the arms of the headset for efficiently utilizing space therein.

* * * * *